US008421628B2

(12) United States Patent
Yang

(10) Patent No.: US 8,421,628 B2
(45) **Date of Patent: *Apr. 16, 2013**

(54) ASSET PROTECTION SYSTEM

(76) Inventor: Xiao Hui Yang, Los Altos, CA (US)

( * ) Notice: Subject to any disclaimer, the term of this patent is extended or adjusted under 35 U.S.C. 154(b) by 177 days.

This patent is subject to a terminal disclaimer.

(21) Appl. No.: 13/021,960

(22) Filed: Feb. 7, 2011

(65) Prior Publication Data

US 2011/0121973 A1 May 26, 2011

Related U.S. Application Data

(63) Continuation-in-part of application No. 12/772,226, filed on May 2, 2010, which is a continuation-in-part of application No. 12/754,031, filed on Apr. 5, 2010, now Pat. No. 8,269,631, which is a continuation-in-part of application No. 12/726,879, filed on Mar. 18, 2010, now Pat. No. 8,305,219, which is a continuation-in-part of application No. 12/498,367, filed on Jul. 7, 2009, now Pat. No. 8,274,391, which is a continuation-in-part of application No. 12/391,222, filed on Feb. 23, 2009, now Pat. No. 8,144,014.

(60) Provisional application No. 61/030,932, filed on Feb. 22, 2008, provisional application No. 61/030,929, filed on Feb. 22, 2008.

(51) Int. Cl.
*G08B 13/14* (2006.01)

(52) U.S. Cl.
USPC ..... 340/572.1; 340/10.1; 340/10.5

(58) Field of Classification Search ..... 340/572, 340/10, 505
See application file for complete search history.

(56) References Cited

U.S. PATENT DOCUMENTS

| | | | | |
|---|---|---|---|---|
| 4,573,042 | A | 2/1986 | Boyd et al. | |
| 4,686,513 | A | 8/1987 | Farrar et al. | |
| 4,797,659 | A | 1/1989 | Larsen | |
| 5,005,125 | A | 4/1991 | Farrar et al. | |
| 5,083,111 | A | 1/1992 | Drucker et al. | |
| 5,245,317 | A | 9/1993 | Chidley et al. | |
| 5,995,002 | A | 11/1999 | Fallin et al. | |
| 6,237,375 | B1 * | 5/2001 | Wymer | 70/14 |
| 6,700,493 | B1 | 3/2004 | Robinson | |
| 6,750,768 | B2 | 6/2004 | Yang et al. | |
| 6,753,821 | B2 | 6/2004 | Yang et al. | |
| 6,838,992 | B2 | 1/2005 | Tenarvitz | |
| 7,068,172 | B2 | 6/2006 | Yang et al. | |
| 7,149,556 | B2 | 12/2006 | Angelo et al. | |

(Continued)

*Primary Examiner* — Travis Hunnings
(74) *Attorney, Agent, or Firm* — Robert R. Waters; Brian W. Foxworthy; J. Michael Wells

(57) ABSTRACT

An asset protection system maintains a radio frequency field or signal in a monitored area. Assets have tags attached to them and are placed in the monitored area. The tags have a mechanism to attach them to the objects and have electronic components on board including a microprocessor, motion detector, radio frequency circuitry, audible alarm generator and in some cases, a passive EAS element. The tags are normally idle in the monitored area, but when the motion detector indicates that a tag is being moved, the RF circuitry checks for a signal or field at an expected frequency. If the tag does not detect a signal, the tag electronics determine that the tag has left the monitored area and generate an audible alarm. If a signal is detected, the tag returns to an idle state once it stops moving. The tags may also alarm if tampered with.

30 Claims, 7 Drawing Sheets

U.S. PATENT DOCUMENTS

| | | | | |
|---|---|---|---|---|
| 7,190,272 | B2 | 3/2007 | Yang et al. | |
| 7,400,254 | B2 | 7/2008 | Yang et al. | |
| 7,446,658 | B2 | 11/2008 | Panotopoulos | |
| 7,474,222 | B2 | 1/2009 | Yang et al. | |
| 7,497,101 | B2 * | 3/2009 | Fawcett et al. | 70/57 |
| D599,242 | S | 9/2009 | Yang | |
| 7,683,761 | B2 | 3/2010 | Burghard et al. | |
| 8,144,014 | B1 * | 3/2012 | Yang | 340/572.1 |
| 2006/0070410 | A1 | 4/2006 | Fuss et al. | |
| 2006/0250241 | A1 * | 11/2006 | Renzetti et al. | 340/572.1 |
| 2009/0058659 | A1 | 3/2009 | Handyside et al. | |
| 2009/0160644 | A1 | 6/2009 | Yang | |
| 2009/0212920 | A1 | 8/2009 | Yang | |
| 2009/0212952 | A1 | 8/2009 | Yang | |
| 2009/0289798 | A1 * | 11/2009 | Yang | 340/572.8 |
| 2010/0052910 | A1 | 3/2010 | Yang | |
| 2010/0171621 | A1 * | 7/2010 | Yang | 340/572.9 |
| 2010/0188227 | A1 | 7/2010 | Yang | |
| 2010/0214102 | A1 * | 8/2010 | Yang | 340/572.9 |
| 2010/0315237 | A1 | 12/2010 | Yang | |
| 2010/0315238 | A1 | 12/2010 | Yang | |
| 2010/0315239 | A1 * | 12/2010 | Yang | 340/572.9 |
| 2011/0115632 | A1 * | 5/2011 | Yang | 340/572.8 |
| 2011/0227706 | A1 * | 9/2011 | Yang | 340/10.1 |
| 2011/0260594 | A1 * | 10/2011 | Yang | 312/297 |

* cited by examiner

ASSET PROTECTION SYSTEM

CROSS REFERENCE TO RELATED APPLICATIONS

This application is a continuation-in-part application based on U.S. patent application Ser. No. 12/772,226 filed on May 2, 2010. U.S. application Ser. No. 12/772,226 is a continuation-in-part application based on U.S. patent application Ser. No. 12/754,031 filed on Apr. 5, 2010 and issued as U.S. Pat. No. 8,269,631 on Sep. 18, 2012. U.S. application Ser. No. 12/754,031 is a continuation-in-part application based on U.S. patent application Ser. No. 12/726,879 filed on Mar. 18, 2010 and issued as U.S. Pat. No. 8,305,219 on Nov. 6, 2012. U.S. patent application Ser. No. 12/726,879 is a continuation-in-part of U.S. patent application Ser. No. 12/498,367, filed on Jul. 7, 2009 and issued as U.S. Pat. No. 8,274,391 on Sep. 25, 2012. U.S. patent application Ser. No. 12/498,367 is a continuation-in-part application based on U.S. patent application Ser. No. 12/391,222 filed on Feb. 23, 2009 and issued as U.S. Pat. No. 8,144,014 on Mar. 27, 2012. U.S. patent application Ser. No. 12/391,222 in turn claims priority to U.S. Provisional Application 61/030,932, filed on Feb. 22, 2008, and U.S. Provisional Application 61/030,929 filed on Feb. 22, 2008. The entire disclosures contained in U.S. patent application Ser. No. 12/772,226, U.S. patent application Ser. No. 12/754,031, U.S. Pat. No. 8,269,631, U.S. patent application Ser. No. 12/726,879, U.S. Pat. No. 8,305,219, U.S. patent application Ser. No. 12/498,367, U.S. Pat. No. 8,274,391, U.S. patent application Ser. No. 12/391,222, U.S. Pat. No. 8,144,014, U.S. Provisional Application 61/030,932, and U.S. Provisional Application 61/030,929, including the attachments thereto, are incorporated herein by reference.

FIELD OF INVENTION

The present application is generally related to asset protection, and more specifically to the prevention of theft of assets, including the prevention of theft of retail items. The several embodiments in the present application comprise both an overall system as well as tags used in that system and may be considered to be generally in the field of electronic article surveillance (EAS). Also, various embodiments of tags of the present application may be used with various electronic article surveillance (EAS) systems in addition to the system of the present application, including for example, an EAS system utilizing tags and deactivators featuring infrared communication for deactivation and alarming and featuring dynamic time based passcode modification and other tamper resistant features, and/or an EAS system using passive EAS element technology.

RELEVANT ART

U.S. Pat. No. 4,686,513 by Farrar et al. is for an "Electronic surveillance using self-powered article attached tags". Alarm tags releasably attachable to articles to be monitored in a retail installation or the like have enhanced operational capabilities giving rise to an improved likelihood of detection of article theft. The system has a transmitter unit which radiates signals containing diverse message contents. The tags each include an attachment device for releasably securing the tag to an article, a receiver unit for receiving such radiated signals and decoding the messages therein, an alarm unit and a signal processor, the latter being responsive to the state of the attachment device and to decoded messages for selectively operating the alarm unit to provide sensible output alarm indication.

In a preferred embodiment, the system includes a transmitter in an exit area of the retail installation which radiates a signal containing a first message for receipt only by tags in such area and has a transmitter in a checkout area which radiates signals containing various selectable messages for article checkout purposes.

U.S. Pat. No. 5,083,111 by Drucker et al. is for a "Jamming Apparatus for Electronic Article Surveillance Systems". In an electronic article surveillance system, a jamming apparatus is provided for establishing a jamming zone in which tags can be situated and not respond to message signals from a surveillance system transmitter and in which the surveillance system receiver can be situated and still respond to tag signals.

U.S. Pat. No. 5,245,317 by Chidley et al. is for an "Article theft detection apparatus". A method and system are provided for monitoring an item within a defined area and sounding an alarm if the item is removed from the area. A transmitter and transducers emit ultrasound which substantially saturates the area to be monitored. A security tag having a detector and alarm is attached to the items to be monitored within the area. Sensing circuits may be additionally provided to determine whether a security tag is being tampered with or removed by an unauthorized person. The security tag's alarm is sounded in the event that the receiver does not detect the ultrasound indicating that the monitored item is no longer in the monitored area. Additional alarms may be provided for indicating that the security tag has been tampered with or removed.

U.S. Pat. No. 4,797,659 by Larsen is for a "Method and a Unit for Synchronizing Burglary Detectors". A method and a unit synchronizes a system for detecting passage of an article through a predetermined area to the mains power wave thereto. The system has a transmitter and a receiver alternately transmitting and receiving electro-magnetic signals as well as a marker secured to the article for receiving said signal and transmitting other signals during article passage of the area. In this manner, undesired interference with a neighboring, like system, is avoided, without the interconnection therebetween, because the existing mains network is employed for the synchronizing.

U.S. Pat. No. 5,995,002 by Fallin et al. is for "Line Synchronized Delays for Multiple Pulsed EAS Systems". A method for initializing an electronic article surveillance (EAS) system which transmits pulses into an interrogation zone and receives signals from the interrogation zone in a sequence of multiple successive transmit and receive windows during each line period of an AC mains supply energizing the EAS system, associated with a corresponding apparatus, comprises the steps of: (a.) determining whether a delay value is stored in a nonvolatile memory; (b.) if the delay value is stored in the nonvolatile memory, loading the stored delay value into a delay control register, terminating the initializing and omitting all remaining steps; (c.) if the delay value is not stored in the nonvolatile memory, loading a first delay value into the delay control register; (d.) determining whether noise in a certain receive window is less than a threshold level; (e.) if the noise is less than the threshold level, terminating the initializing and omitting all remaining steps; (f.) if the noise level is not less than the threshold level, loading a second delay value into the delay control register; (g.) determining if the EAS system is operating properly; (h.) if the EAS system is operating properly, terminating the initializing and omitting all remaining steps; (i.) if the EAS system is not operating properly, loading the first delay value into the delay control register; and, (j.) terminating the initializing.

Systems that rely on frequent or consistent signals from tags exacerbate limitations of the tags. Transmitting a radio frequency signal places a high demand on the power supply of a tag, and the quality of the signal from a tag is highly dependent upon the orientation of the tag. Because of this, even more power may be needed from a power supply to compensate for a tags deviation from the optimum orientation, particularly when the component of the system receiving a signal from a tag, is at some distance from the tag. The power supply is most typically a battery. The larger the distance between a transmitting object and a receiving object, the stronger the original signal needs to be and the more power required. This distance factor requires either more power for the tag transmitter or a large number of receiving antennas, or some combination of both. Greater power requirements for the tag decrease tag life. Larger numbers of antennas or large antennas add to the cost of the system.

Other limitations of prior art systems involve coordinating transmissions from multiple tags. Depending on the particular regulatory regime, a system will operate at a given frequency and monitor that frequency for communication from the several tags located in a monitored area. If the tags transmit at the same time, their signals will interfere with each other. In order for prior art systems to track tags and the associated products, the tags must periodically check in with the system via transmissions at the particular frequency. When systems employ multiple tags transmitting information back to the broader system, various schemes need to be employed to ensure that tag signals don't interfere with each other, so that the system can receive the tag signals. This adds complexity to the system, and the scheduled transmissions from the tags consume energy which shortens tag life. The frequent tag transmissions required by these schemes and the need for adequately powered tag signals leads to a limited life for the power source and therefore unsatisfactory tag longevity. Hence there is a need for a system facilitating long battery life for both economical and efficacy reasons.

SUMMARY OF EMBODIMENTS OF THE INVENTION

Embodiments of the present invention are for anti-theft electronic article surveillance systems and tags. The tags have the ability to generate an alarm signal under conditions indicating theft. The systems operating with these tags facilitate a long battery life for the batteries powering the tags.

The tags comprise: a microprocessor; a motion sensor; a radio frequency (RF) transmitter and receiver, or RF transceiver; an audible alarm generator; a battery powering the foregoing elements; an attaching mechanism for releaseably attaching the tag to an object, and sometimes a locking device associated with the attaching mechanism; and some embodiments may include a passive EAS element. The electronic components powered by the battery perform several logic and communication functions. The microprocessor is capable of storing and executing programmed instructions. The motion sensor functions to determine when the tag is being moved. The motion sensor may actually detect motion, or the motion sensor may monitor the orientation of the tag, for example, by sensing gravity, and interpret a change in orientation of the tag as motion.

The electronics of the tags are normally idle, except for the motion sensor and the limited requirements on the microprocessor to monitor the motion sensor. When the motion sensor indicates that the tag is in motion, the rest of the electronics begin to have roles. When the tags are activated, the radio frequency receivers, or transceivers, monitor for radio frequency signals, or fields, that they expect to detect. If the expected fields, or signals, are not detected by the radio frequency receivers, the tags will self alarm and produce an alarm. In some embodiments, this alarm may be an audible alarm to notify surrounding persons. In other embodiments, the alarm may be a radio signal alarm detectable by other elements of the system. If the expected signal fields are detected by the radio frequency receivers, the tags will simply continue to monitor for the signal fields for a predetermined time after the tags come to rest. Once the tags are at rest for the predetermined period, the tags will go idle again, except for the motion sensor and monitoring microprocessor. Receivers can be placed at locations where tag alarm signals are anticipated so that tag signals need not be overly powerful and drain the onboard battery. The infrequent broadcast by the tags, along with the shorter range required of the signal, reduces drain on the power source and greatly extends the life of a tag.

The operation of the tags described above function in cooperation with a larger EAS system. Assets that are to be monitored have tags releasably attached to them and are located in a given area protected by the EAS system. The system generally saturates the protected area with a radio frequency signal. In some embodiments, the RF signal has a code modulated onto the signal. When objects with the above described tags are moved within a protected area, the motion transmitted to the associated tag is detected by the motion sensor being monitored by the microprocessor. The microprocessor and transceiver circuitry then begin to monitor for the signal. Since the tag is in the protected area it receives the signal and remains quiescent as far as the audible alarm is concerned. The transceiver also does not transmit an RF alarm. When an object to which a tag is attached is removed from a protected area, the motion transmitted to the associated tag is detected by the motion sensor being monitored by the microprocessor. The microprocessor and transceiver circuitry then begin to monitor for the signal. As the tag is removed from the prescribed area, it loses the signal, and the microprocessor executes instructions to issue an audible alarm via the audible alarm generator. The tag may also transmit an RF signal alarm. Receivers may be located at anticipated locations such as exits or positioned close enough to easily detect a tag RF signal. The alarm continues to sound until the tag is instructed to cease alarming by the system. This may be by returning the object and its accompanying tag to the protected area where the signal is obtainable, or by more specific instructions from the system via RF communications. In some embodiments, the tags may continue to alarm even after being returned to the protected area and may require specific instructions from the system to cease alarming. Also, if a tag is blocked from detecting the field, for example, by being wrapped in metal foil, the tag will not be able to detect the field and will alarm as if it has been removed from the protected area.

In at least one embodiment, the system saturates the protected area with the signal by using multiple signal radiating units which comprise signal radiating elements such as signal generating circuits, and antennas. The signal radiating units can be mounted overhead with their signal directed downward. This positions the signal radiating units out of the way, and allows the fields of their signals to expand downward toward the occupied space of a protected area, where the majority of objects and tags are located. The radiating units may also be located at ground level when preferred. The radiating units have external power sources ultimately based on the ubiquitous alternating current system and therefore are not limited in their power capabilities as the tags are. In at least one embodiment, the radiating units use a characteristic of the mains power system to synchronize their transmission of signals. A typical characteristic that is used is a zero crossing of a phase of the mains power supply alternating current.

In at least one embodiment, the signal radiating units have power transformers to convert the available power to a different voltage required for the electronics of the signal radiating units. Also, where it is possible to use a single antenna to cover the entire protected area, the system would work with a single antenna to generate the signal field as well.

The use of several radiating units allows the signal field of the protected area to be closely tailored to the physical contours of the protected area. Additionally, some radiating units may transmit a canceling, or interference, field to attenuate the signal in particular areas. For example, radiating units nearest exits from the protected area may transmit a canceling field so that the signal is attenuated at the exits but within the physical space of the protected area. In application in a retail environment, this would mean that a tag on an object being improperly removed from the retail store would lose the system signal while still in the store. The tag would then sound an audible alarm while still in the retail store in proximity to store personnel, and receivers located near the exits can pick up RF alarms from an exiting tag. Some embodiments of the system may employ transmitter systems at ground level to generate the canceling field as this may facilitate a highly local effect at an exit or other area where it is desired to cancel the signal. Radiating units transmitting the cancelling field may also use alternating current characteristics of the mains power supply to synchronize with each other as well as with radiating units transmitting the saturating signal field. This allows signals from alarming tags to be received with minimal interference when all radiating units periodically stop transmitting in synchrony.

In one embodiment of the system, the signal field generated over the monitored area has a code modulated onto it. When a tag is moved and scans for the presence of the signal, it decodes the signal for confirmation that it is still in the monitored area. In an area where it is desired that the field be attenuated, an interference signal is broadcast at the same frequency, or nearly the same frequency, as the monitoring field. This interference signal does not have the code modulated onto it like the monitoring field does. The nearness in frequency of the two fields inhibits the tag's ability to cleanly receive and decipher the code modulated onto the monitoring field, effectively canceling the monitoring field within the range of the interference field. Failing to receive and decipher the code, the tag issues an audible alarm, and in some embodiments, an RF alarm signal receivable by receivers located specifically at a location to receive the tag RF alarm signal. These receivers would be located where tag alarms would be expected such as at areas where the field is intentionally attenuated, like exits, etc. Any of the radiating units may also comprise a receiver to allow them to detect a tag alarm signal, and a transceiver configuration may also be used in the radiating units.

In addition to the basic anti-theft alarming functions, the tags are capable of data storage. This capability is helpful for inventory management and theft deterrence. Each tag can store its own identifier and a passcode for security purposes, as well as information about the object to which it is attached. A controller associated with the system communicates the object information to the tag, typically when the tag is attached to the object. In at least one embodiment this communication occurs via radio frequency transmission from a transmitter associated with the controller and received by the transceiver of the tag being attached to the object. The information for the object, the tag identifier, and any passcode, may be stored in a database accessible by the controller such as on an associated computer. On the tag, the data is stored by the microprocessor. In a retail setting, when merchandise is added to an area and tags attached to the merchandise, the information about the object can be transmitted to the tag and the tag identifier assigned to the tag. In some embodiments, a tag may have a permanent identifier, while in other embodiments the tag identifier may be added as the tag is brought into the system. Similarly, once a tag is associated with an object, or piece of merchandise, in a database, the tag identifier is sufficient to identify the tag. In at least one embodiment, transmission from the tag is limited to alarming conditions and direct interrogation of the tag by the controller during entry or removal from the system of either the tag or the object being protected, or both. As discussed above, this limiting of transmissions from the tag greatly lengthens the life of the power supply of the tag, usually a battery.

Embodiments of tags may vary widely in how they releasably attach to the objects they are protecting. The various attaching mechanism available to attach a tag to a protected object include: tack and clutch mechanisms; lanyards; pivoting members clamping around the object, and; adhesive elements. Some embodiments of tags will have tamper detection capabilities which will vary depending on how the tag attaches to an object. For example, lanyard tags may employ a lanyard with a conductive element, so that when a lanyard is cut to remove a tag, an electrical conductive circuit is changed, indicating tampering. Other tags may employ switches to indicate when parts of a tag are being separated without authorization or without the tag being disarmed.

Some embodiments of the tags may carry a passive EAS element. These passive EAS elements work with EAS systems that generate interrogation fields at exits or other areas of interest. There are at least two types of passive EAS elements.

One type of passive element comprises a wire coil and ferrite core. While transmitting, the interrogation field builds up energy in the coil and core element. When the interrogation field ceases, the energy in coil and core elements dissipates and generates a signal that is a harmonic of the interrogation field. The EAS system monitors for these harmonics, and when a harmonic signal is detected, the system determines that a tag is present in the monitored area and an alarm condition is determined.

Another type of passive tag uses two small metal strips. One has a magnetic bias to it, while the other does not. The two strips are arranged in proximity to each other with only limited constraints and together are tuned to resonate when brought into an interrogation field. The resonance produces a signal which the EAS system can detect. Detection of the signal produces an alarm condition in the EAS system.

In addition to alarming when a system signal is not received, some tag embodiments will alarm when an attempt is made to remove the tags from a protected object without authorization. These tags employ switches and other sensing methods to detect when a tag has been removed, or an attempt is being made to remove them, and the tag alarms when that is determined. This tag alarm may be an audible alarm, an alarm signal transmitted at a specified frequency, or both.

BRIEF DESCRIPTION OF DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS OF THE INVENTION

Figure 1:
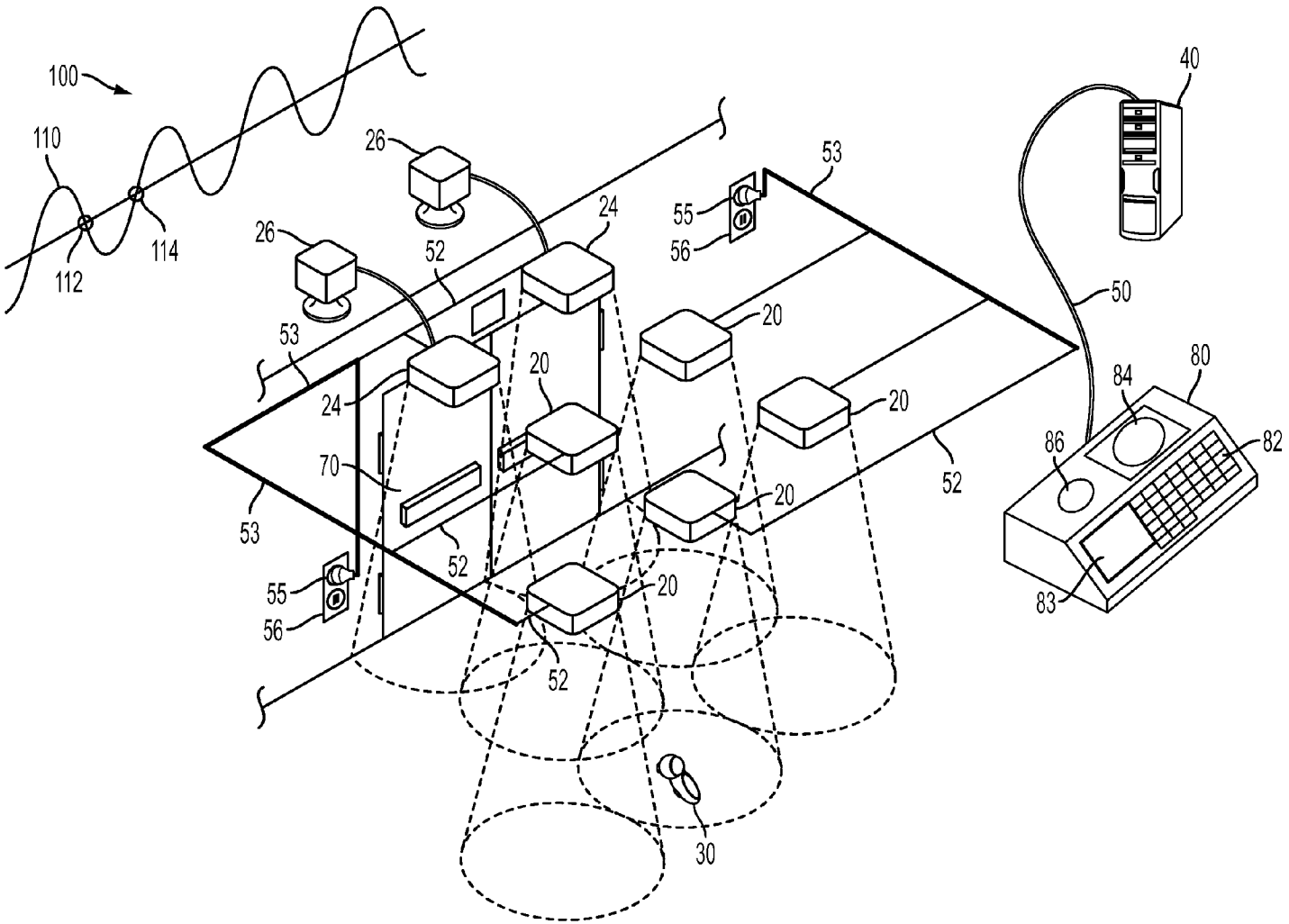
FIG. 1 is a perspective view of an asset protection system according to one embodiment of the invention.

FIG. 1 is an overall view of the asset protection system 10. A plurality of signal, or field, transmission units 20 and 24 are used by the asset protection system 10 to create and shape a monitoring field in a protected area. In one embodiment, each transmission unit 20 and 24 has a programmable controller, memory, signal transmitting and receiving means, and standard power cords 52 for power. Other embodiments may have an onboard power transformer to change the voltage of the power received through power cord 52 to accommodate onboard electronics. Computer 40 performs database functions and other data intensive functions and connects to controller 80 with cable 50. Controller 80 provides a means of interacting with tags 30 as well as performing some data entry functions.

Each transmission unit 20 and 24 is independently capable of radiating an area with a radio frequency field, although, as discussed in more detail below, transmission units 20 and 24 perform different functions. The transmission units operate as signal transmission units 20 and interference transmission units 24. In at least one embodiment the transmission units 20 and 24 are mounted overhead with the individual fields generated by each transmission unit expanding as it reaches down into the occupied levels of the monitored area. This allows the entire target area to be covered without intrusive installations at the level where persons and objects will be located. A sample tag 30 is shown in FIG. 1. Tags 30 are releasably attached to items to be protected and generate alarms under particular conditions.

Signal transmission units 20 transmit a field at a known frequency and, in at least one embodiment, are powered by standard wall outlet power as shown in FIG. 1. Power cords 52 may be connected and bussed together through conduits 53 to plugs 55 at wall outlets 56, or they may be dispersed enough to rely upon their own power cords 52 to plug into wall outlets. As illustrated in FIG. 1 at 100, the mains power supply for asset protection system 10 comprises a sinusoidal voltage wave 110 having characteristic points in the wave such as zero crossing points, two of which are indicated at 112 and 114. Zero crossing point 112 occurs on a decreasing slope of sinusoidal voltage wave 110 and zero crossing point 114 occurs at an increasing slope of sinusoidal voltage wave 110. There are other characteristic points such as maximum, minimums, etc. Signal transmission units 20 and interference transmission units 24 are capable of detecting particular points, such as zero crossing points 112 and 114, in sinusoidal voltage wave 110 and using the detected points as references to synchronize with each other. By synchronizing with each other, transmission units 20, 24, can continuously monitor an area by generating intermittent fields which are continuously turned on and off in synchrony. When transmission units 20, 24 are off, interference transmission units 24 can monitor for signals from tags at specified frequencies. Synchronization prevents different transmission units from contaminating the monitoring periods of other transmission units. While in some embodiments of asset protection system 10, signal transmission units 20 may be able to monitor for signals from tags 30, in most embodiments of asset protection system 10, only interference transmission units 24 will monitor for tags signals, since interference transmission units 24 will be located at exits to shape the monitoring field.

In at least one embodiment, the signal field generated by signal transmission units 20 has a validation code modulated onto it. An EAS tag operating as part of the asset protection system, such as tag 30 shown in FIG. 1, can detect the signal field generated by signal transmission units 20 to confirm that it is presently in the protected area and also decipher the validation code from the signal field. A tag 30 failing to detect the signal field when expected, and decipher a validation code when a validation code is being used, will determine an alarm condition and generate alarms. This will be described in more detail below. A tag may fail to detect the signal field because it has been removed from the monitored area or because it is being blocked from receiving the signal field, for example, by being wrapped in metal foil or being placed in a foil lined bag.

In some embodiments and applications, it will be desirable to shape the signal field by attenuating it in particular areas. For example, it is preferred that the signal field not bleed out through exits from the monitored area, so that tags such as tag 30 will alarm while still on the internal side of the exit. If the signal field still has a strong enough presence on the external side of the exit, a tag will detect it and fail to determine that it has been transported outside of the protected area.

Referring again to FIG. 1, exit 70 consists of two doors leading from the monitored area. Above exit 70 are two interference transmission units 24 that combine to broadcast an interference field in front of exit 70. This interference field is at a frequency that is within the receiving bandwidth of tag 30 and the interference field does not have the validation code. In the spaces where the monitoring field overlaps the interference field, there are two fields at frequencies within the receiving bandwidth of tag 30, only one of which, the monitoring field, has the validation code modulated onto the field. The presence of the interference field in the tag's 30 receiving bandwidth, prevents tag 30 from accurately deciphering the validation code from the monitoring field. The failure to decipher the validation code from the monitoring field causes tag 30 to determine an alarm condition and take appropriate action as provided by the machine readable instructions programmed into its microprocessor. Among the actions that tag 30 may take is the generation of an audible alarm and the transmission of a radio frequency alarm signal.

In addition to generating interference fields, interference units 24 can also scan for signals from alarming tags 30. In at least one embodiment, tags 30 transmit their alarm signals at frequencies that vary sufficiently from the monitoring field and the interference field that there is no interference between those broader fields and the alarm signals of tags 30. Interference transmission units 24 can be located in relatively close proximity to where alarming tags are expected, which decreases the strength requirements for a signal coming from a tag. This decreases the power drain from the tags power supply. The radio frequency alarm transmission from tag 30 can also communicate coded information such as the identifier number stored on tag 30. When an interference transmission unit 24 detects an alarm signal from an alarming tag 30, it can alarm as well. In the embodiment shown in FIG. 1, interference transmission units 24 are connected to audible alarm generators 26 which generate audible alarms when energized by interference transmission units 24. In other embodiments of the asset protection system, interference transmission units 24 may be connected to lights to generate visual alarms by flashing the lights, etc.

Figure 2:
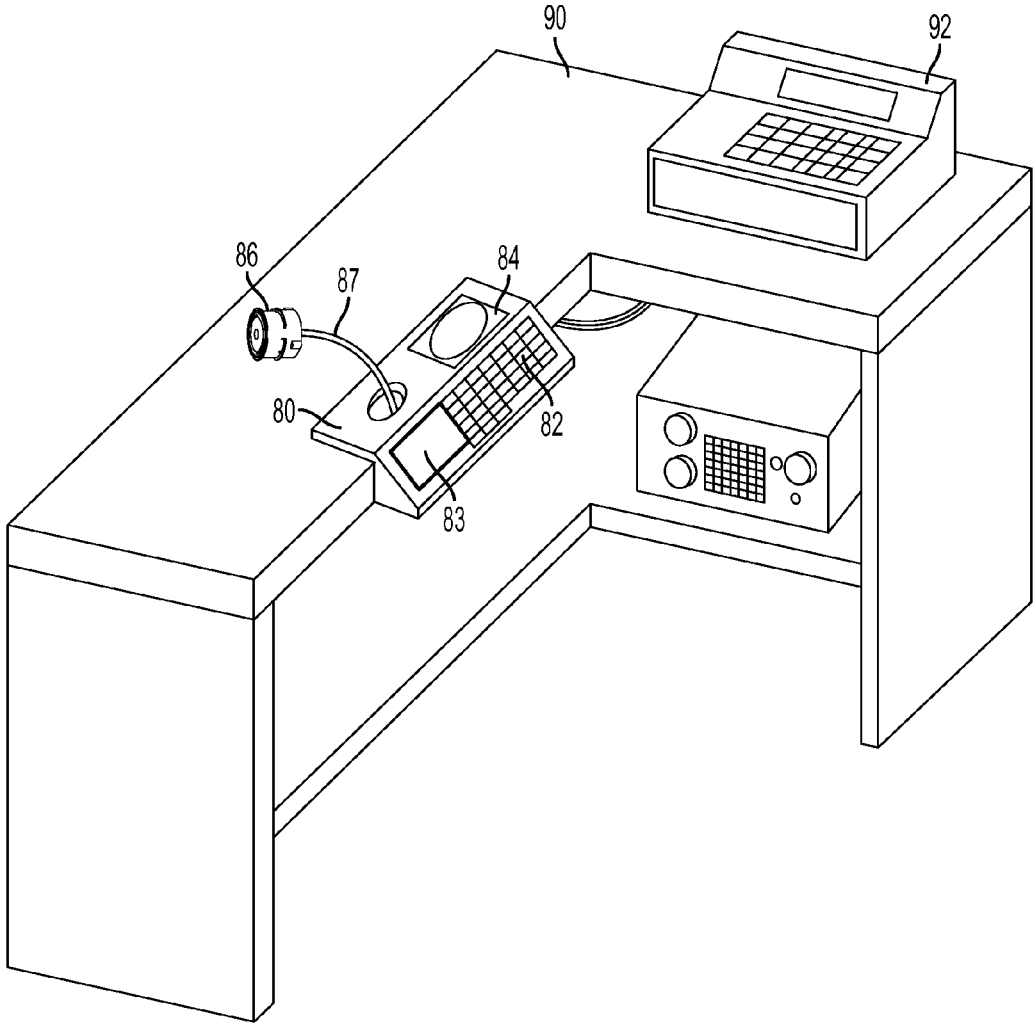
FIG. 2 shows a controller installed at a retail counter.

Referring still to FIG. 1, controller 80 is connected to computer 40 by cable 50. The embodiment of controller 80 shown in FIG. 1 has a keypad 82 for command and data entry, a display screen 83, a communication pad 84 for radio frequency communication with tag 30, and a detacher 86 for allowing tags 30 to be detached from objects. FIG. 2 shows controller 80 installed at a checkout counter 90 in a retail application. Also shown in FIG. 2 is a cash register 92. In retail environments, most products and protected objects will be processed out of the monitored area via a checkout counter like the one shown in FIG. 2 at checkout counter 90. Communication pad 84 of controller 80 is comprised of transmitting and receiving elements that can communicate via RF frequency signals with tag 30, which is attached to protected objects being checked out of the monitored area, or store. The transmitting and receiving elements of communication pad 84 are sometimes combined into transceivers. The transmitting capabilities of tag 30 used to broadcast an RF alarm signal can also transmit information to communication pad 84, while the receiving capabilities of tag 30 can receive information from communication pad 84.

Communication pad 84 can exchange data information with tag 30 as well as making changes to the machine readable instructions stored on a microprocessor in tag 30. The close proximity of communication pad 84 with tag 30 at checkout decreases the strength of signal that tag 30 needs to transmit. At checkout, controller 80 can query tag 30 to receive from the tag 30 the unique identifier that was assigned to tag 30 at a previous point in time. Controller 80 can also receive from tag 30 information about the object to which tag 30 is attached. This information about the object can be imparted to tag 30 at the time tag 30 is attached to the object. Alternatively, the unique identifier assigned to tag 30 can be associated with the object and its information within a relational database at the time that tag 30 is attached to the object. In the relational database, knowledge of the identifier of the tag is then sufficient to know to which object that tag is attached. When the object is checked out, the system can record and date stamp the transaction and remove the object from inventory. Information about the transaction can be recorded such as an employee identifier, customer identifier, etc. The ability to store an employee identifier aids in prevention of internal theft as well as other employee management tasks. The ability to store a customer identifier with a transaction allows a retailer to develop customer profiles, etc. Keypad 82 facilitates interaction between a user and the system and display screen 83 provides visual information for the user.

In the embodiment shown in FIG. 2, controller 80 also has detacher 86 associated with it. Detacher 86 facilitates the detachment of tag 30 from the object, and in at least one embodiment detacher 86 has a magnet which, when detacher 86 is brought into proximity to a tag, facilitates the release of the tag from the object. In FIG. 2, detacher 86 is shown removed from a nest in controller 80 so that it may be brought into close enough proximity with a tag to allow it to be release from the object being protected. Detacher 86 is maintained in association with controller 80 by cable or tether 87. Some embodiments of tags are programmed to determine an alarm condition and to alarm when a tag is removed from an object without authorization. In those situations, communication pad 82 of controller 80 can deactivate, or disarm, a tag prior to the tag's detachment from the object. In programmable embodiments, this disarming is accomplished by changing a setting in the machine readable instructions of a microprocessor carried by the tag.

Some embodiments of the asset protection system will employ passcodes. An anti-theft tag 30 can store a security passcode. When controller 80 interacts with tag 30, it can transmit the passcode to tag 30 which compares to a value stored by tag 30. If the passcode transmitted by controller 80 to tag 30 and the stored value match, tag 30 disarms and it may be released from the item to which it is attached without an alarm being generated. If the system employs a unique passcode for each tag 30, then controller 80 must first receive a unique identifier associated with a given tag 30. With that information, controller 80 can determine the correct passcode and transmit it to tag 30 to disarm tag 30. An incorrect passcode will not cause tag 30 to disarm and subsequent removal of tag 30 will cause an alarm condition.

Some embodiments of the EAS system may employ time base algorithms to periodically change passcodes. In those cases, each tag will also have an onboard clock. At specified intervals, the passcode is changed according to the algorithm. If each tag has a unique passcode, the system, which will also have at least one clock, can track the changing passcodes for each tag based on knowing a tags passcode at some given initial time. Other embodiments of the system, may use a single passcode system wide. In this embodiment, each element has a clock and the same passcode at any given time. At specified intervals, each element updates its own passcode according to the algorithm to a new passcode which is the same for each element in the system.

Each interaction between the system at large and a tag 30 is trackable and recordable by the system's server and computer elements. When a tag 30 is applied to an object to be protected, the tag and its associated object is entered into the database functions of the system. Because a tag is only required to communicate with receivers in relatively close proximity to it, a tag does not need to expend excessive energy transmitting information to the system at large. Both the communication pad 82 of controller 80 and the interference units 24 can be located to provide close proximity to tags 30. Communication pad 82 and interference units 24 are not limited in their access to power as are tags 30.

Figure 3:
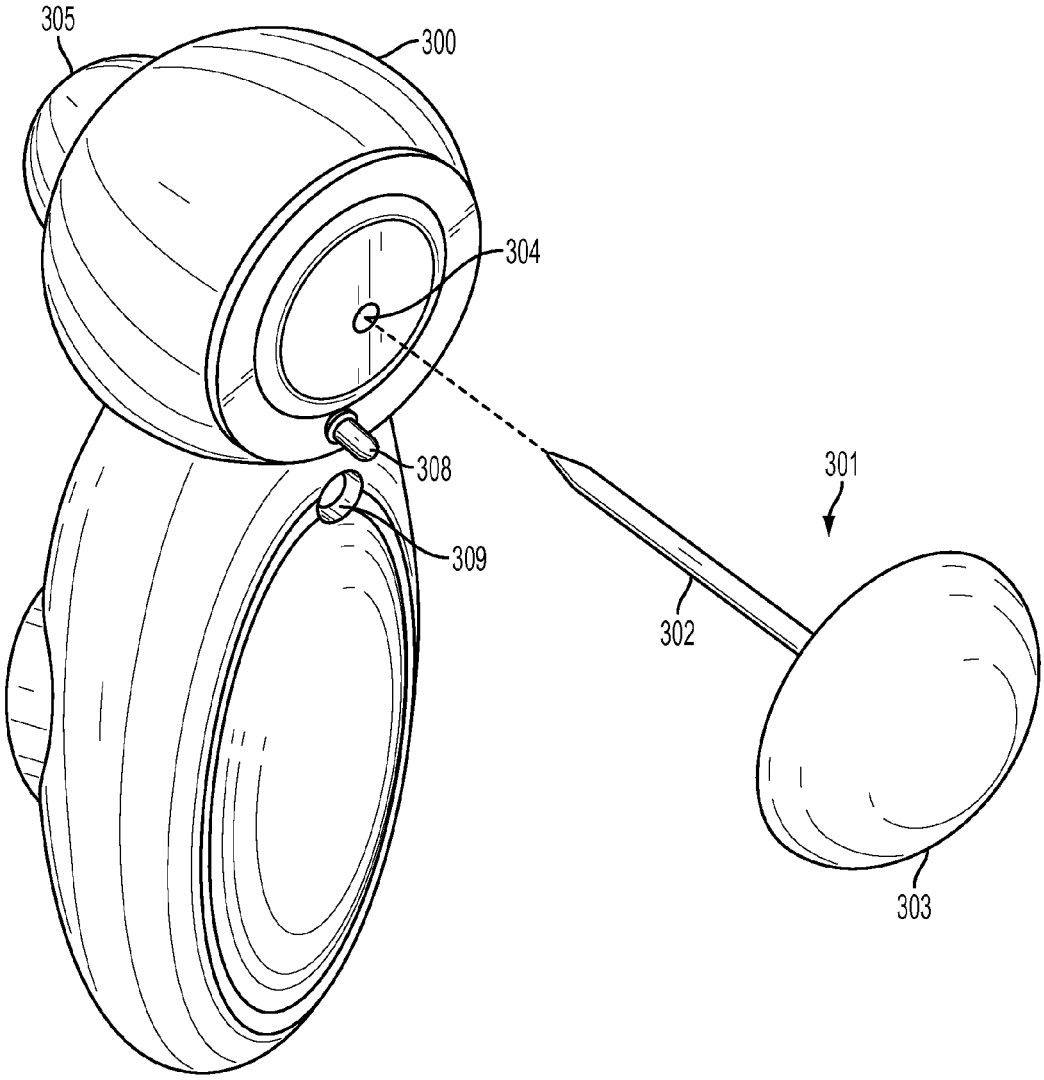
FIG. 3 is a top perspective view of a tack attached tag compatible with at least one embodiment of the asset protection system.

Referring now to FIG. 3, tag 300 is compatible with the asset protection system. In the embodiment shown in FIG. 3, tag 300 is attached to an object to be protected by tack 301. Shaft 302 of tack 301 passes through an object to be protected and into tack aperture 304, where it is releasably retained. The object to be protected may be an article of clothing, etc. Tag 300 carries active electronic article surveillance (EAS) electronics, a battery to power the active electronics, and in some embodiments, a passive EAS element, as well as tamper detection sensors.

Figure 4:
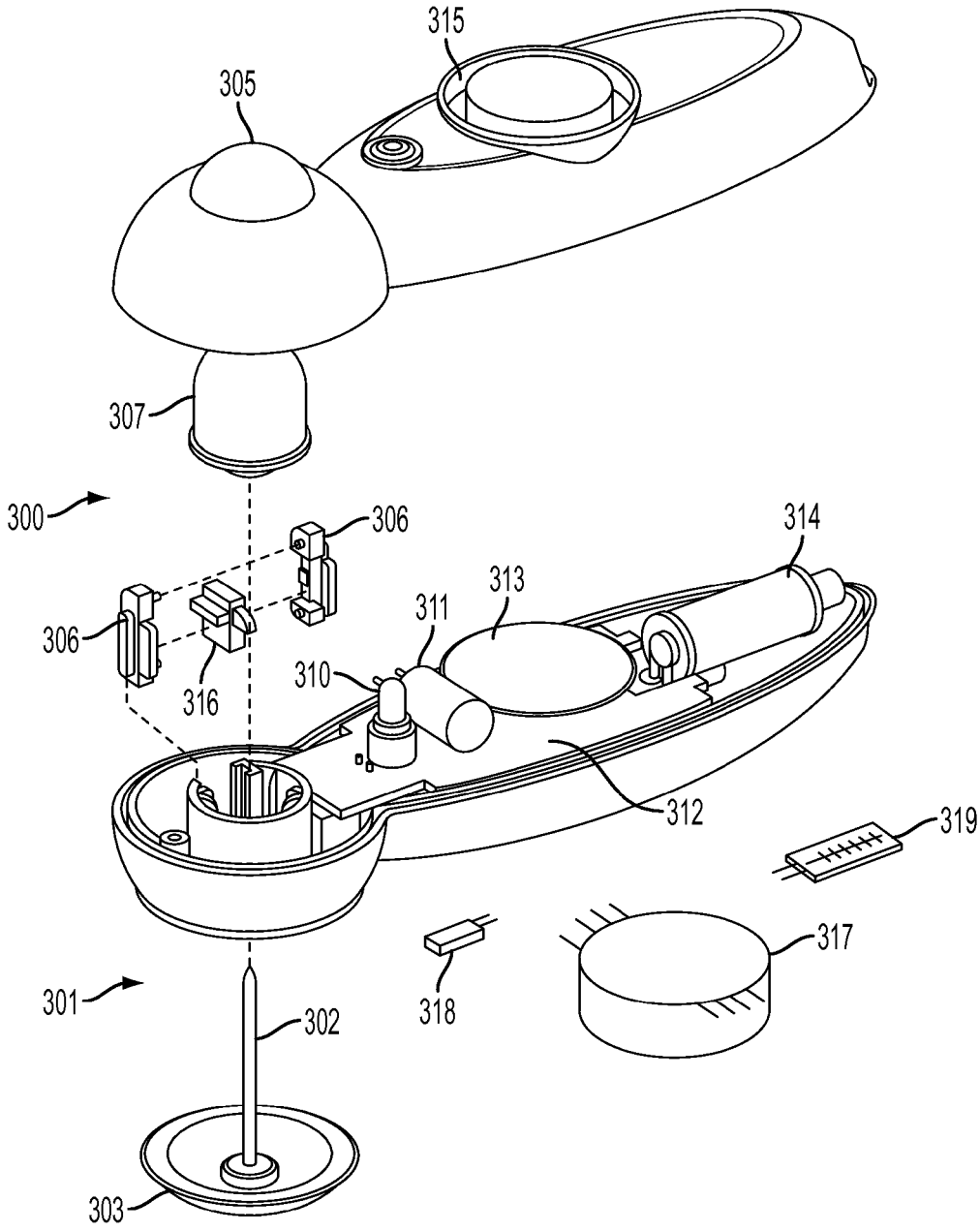
FIG. 4 is an exploded perspective view of the tack attached tag of FIG. 2.

FIG. 4 is an exploded perspective view of the tack attached tag 300 of FIG. 3, and shows several of the elements internal to tag 300. At the left end of tag 300 are elements associated with attaching tag 300 to an item to be protected, such as clutch housing 307, shaft switch 316, and tack 301. In the center and to the right of tag 300 are electronics elements for active security functions of tag 300. Located within tag 300, and shown attached to circuit board 312, are light emitting diode 310, battery 311, and audible alarm generator 313. Normally attached to the bottom of circuit board 312, in this embodiment of tag 300, but shown outside of tag 300 in FIG. 4 are microprocessor 317, motion sensor 318, and a radio frequency receiving and transmitting circuitry 319. In some embodiments, receiving and transmitting circuitry function as a transceiver. The microprocessor is capable of storing machine readable instructions and executing those machine readable instructions based on inputs from the other elements in tag 300. In addition to these powered electronics, passive EAS element 314 is also shown in FIG. 3.

When attached to an object to be protected and when the object to be protected is placed in a protected area such as shown in FIG. 1, tag 300 works in conjunction with transmission units 20 and interference units 24 to prevent the theft of the object. Transmission units 20 maintain a radio frequency field, or signal, throughout the protected area, while interference units 24 attenuate the field, or signal, near an exit or other area of interest. When the object to be protected and the associated tag 300 are still, the powered electronic elements of tag 300 are normally dormant except for motion sensor 318 and microprocessor 317. Microprocessor 317, however, operates in a minimized mode, being only active enough to monitor motion sensor 318. When tag 300 is moved, motion sensor 318 detects the motion, triggering microprocessor 317 to switch to an active mode and monitor RF circuitry 319 for information. If RF circuitry 319 detects an RF signal, or field, at an expected frequency, microprocessor 317 determines that tag 300 is still present in the detected area, and when tag 300 ceases to move for a predetermined amount of time, the powered electronic elements of tag 300 return to a predominantly idle state. If motion sensor 318 conveys to microprocessor 317 that tag 300 is moving, but RF circuitry 319 does not convey to microprocessor 319 that an RF field is present at the expected frequency, microprocessor 317 determines that tag 300 has been moved to a prohibited location such as the neutral area created by interference units 24 near an exit, or even a location beyond the field generated by transmission units 20. In some embodiments of the asset protection system a code will be modulated onto the monitoring field and tag 300 will attempt to decipher the code. If tag 300 cannot decipher the code from the signal, the tag 300 will determine an alarm condition and alarm. Whatever the reason for the lack of signal, or decipherable code, received by RF circuitry 319, microprocessor 317 causes audible alarm generator 313 to generate an audible alarm. This audible alarm can be heard by personnel and appropriate action taken. If a person attempts to block the signal from tag 300 by, for example, wrapping tag 300 in metal foil, the result will be the same as if tag 300 is removed from the protected area since tag 300 will not receive the signal and won't be able to decipher a code transmitted on the signal. In addition to an audible alarm generated by audible alarm generator 313, tag 300 can send out a radio frequency alarm with RF circuitry 319. This radio frequency alarm is at a frequency sufficiently apart from the field frequency that it will not be interfered with by either the monitoring field or the interference field. Interference transmission units 24 can be strategically placed to be able to pick up the RF signal from alarming tags.

Once audible alarm generator 313 begins to alarm, it continues to alarm until conditions are met to cease alarming. These conditions can vary depending on the preferences of the user of the system. One condition may simply be the resumption of the RF field or signal, i.e. the return of tag 300 to the protected area where radio frequency receiver 319 can detect the signal. Another condition may be an instruction to cease alarming modulated onto the radio frequency signal of the protected area or at another radio frequency used specifically for that purpose. This instruction to cease alarming can be initiated by authorized personnel. Another condition that may cause tag 300 to cease alarming may be depletion of battery 311.

There are various approaches to determining whether tag 300 is being moved. In one embodiment, motion sensor 318 employs an accelerometer, such as a piezoelectric accelerometer, to directly detect that tag 300 is being moved. In another embodiment, motion sensor 318 actually monitors the orientation of tag 300 by sensing gravity. If the direction of gravity changes, then motion sensor 318 determines that tag 300 has changed its orientation and is being moved.

Some embodiments of tag 300 will alarm under other circumstances in addition to not detecting an expected radio frequency signal or field. Cap switch 308, shown in FIG. 3, and shaft switch 316 shown in FIG. 4, provide indications of tampering if their state changes without the electronics of tag 300 being disarmed by a controller 80. When tack shaft 302 is inserted into tag 300, shaft switch 316 is actuated by tack shaft 302. Similarly, when a tag 300 is attached to an object and a layer of material is caught between tag cap 303 and the body of tag 300, cap switch 308 is actuated. Actuation of either switch can be used to arm tag 300 to begin monitoring for a radio frequency signal, and a later change in status for either switch can be used to trigger an audible alarm by alarm generator 313. If cap switch 308 or shaft switch 316 experience a change in state without tag 300 being disarmed, then the electronics of tag 300 determine that tack 301 has been removed from tag 300 without authorization and an audible alarm can be sounded by audible alarm generator 313 or tag 300 may also transmit an RF alarm signal, or both.

Passive EAS element 314 shown in FIG. 3 adds an additional security feature. EAS element 314 operates with EAS systems in which interrogation fields are established at exits or other control areas. Some passive EAS elements are comprised of a coil and core construction. When the interrogation field is active it builds up energy in the core and coil. When the interrogation field is temporarily discontinued, the energy dissipates from the core and coil assembly and generates a signal that is a harmonic of the original interrogation field. The EAS system monitors for these signals and if one is detected, the system determines that a tag is present in the interrogation field and an alarm may be generated. Other passive tags are comprised of two metallic strips which are loosely mounted in proximity to each other. The two strips are designed and sized to resonate when placed in the interrogation zone. The EAS system is tuned to detect the signal from the resonant EAS tags. Passive EAS element 314 is depicted as the coil and core type. However, tag 300 could just as easily carry the resonant style of tags.

Figure 5:
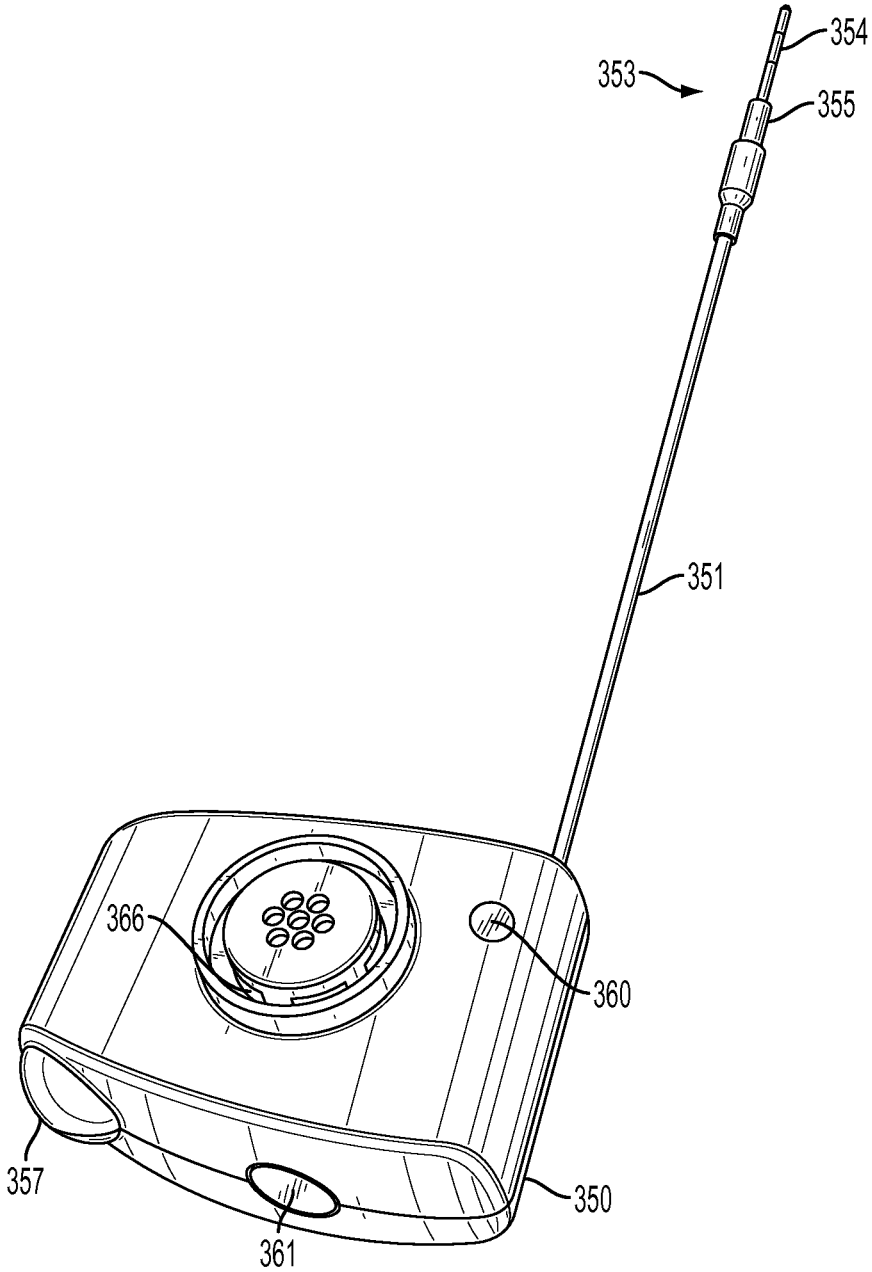
FIG. 5 is a perspective view of a lanyard tag compatible with the intelligent asset protection system.
Figure 6:
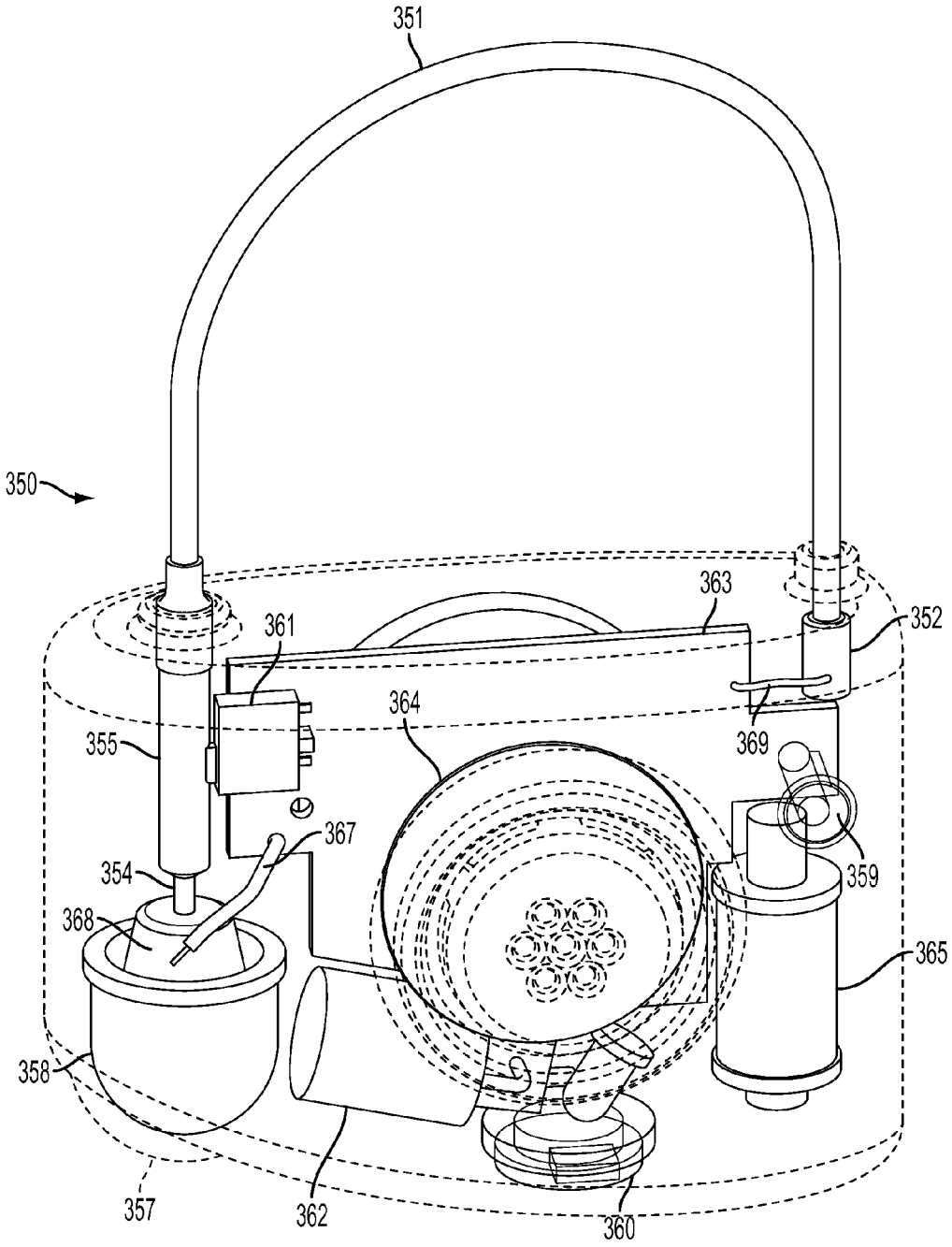
FIG. 6 is a perspective view of the lanyard tag of FIG. 4 with the outer shell made transparent.

FIG. 5 is a perspective view of a lanyard tag compatible with the intelligent asset protection system. FIG. 6 is a perspective view of the lanyard tag of FIG. 5 with the outer shell made transparent. As may be seen in FIG. 6, lanyard tag 350 is capable of carrying the same electronics as tag 300 of FIGS. 3 and 4. Visible in FIG. 6 are circuit board 363, battery 362, audible alarm generator 364, and passive EAS element 365. Not visible in FIG. 6 is a microprocessor, motion detector, and radio frequency receiver which are mounted on the opposite side of circuit board 363 in the embodiment shown in FIG. 6.

Although lanyard tag 350 shown in FIGS. 5 and 6 operates in the asset protection system essentially the same as tag 300 of FIGS. 3 and 4, lanyard tag 350 attaches to an object to be protected with a different mechanism and therefore the tamper indicators in lanyard tag 350 are different. Lanyard tag 351 attaches to an object to be protected by encircling some portion of that object with a lanyard. Lanyard 351 has a permanently anchored end 352 and a coupler end 353, and, in some embodiments, along its length, some portion of lanyard 351 is made of an electrically conductive material. In particular, many embodiments of lanyard tag 350 will have a lanyard 351 having its core made of an electrically conductive cable. Coupler end 353 of lanyard 351 has a retention pin 354 section and a contact cylinder 355 section. To retain lanyard tag 350 on an article, lanyard 351 is passed through the article and retention pin 354 is inserted into aperture 356, where it is retained by a mechanism located in lanyard tag 350. Alternatively to passing lanyard 351 through an article, lanyard 351 may be passed around some location on an article where it may not be easily removed. In one embodiment of tag 350, the mechanism that retains retention pin 354 in aperture 356 is a ball clutch which can be made to release retention pin 354 by application of a magnet to clutch cone 357 visible on the bottom of lanyard tag 350 in FIGS. 5 and 6. In some embodiments, clutch housing 358, visible in FIG. 6, has at least some magnetically attractable material in it, and is the element acted upon by the magnet to release retention pin 354.

In addition to alarming when it is being moved and no system signal is detected, lanyard tag 350 is capable of self alarming upon the occurrence of any one of several events. One event that can trigger self alarming by tag 350 is physical tampering with the tag. A common attack used against lanyard type tags is the cutting of the lanyard. Referring to FIG. 5, once coupler end 353 of lanyard 351 is inserted through aperture 356 and into retention mechanism 368, two tamper detection circuits are completed. A first tamper detection circuit includes clutch wire 367, retention mechanism 368, retention pin 354, contact cylinder 355, and switch 361 and is completed on circuit board 363 (microprocessor, etc.). This first tamper detection circuit establishes that coupler end 353 of lanyard 351 has been inserted. A second tamper detection circuit includes lanyard wire 369, lanyard 351 and can be completed by two possible routes. One completion route includes contact cylinder 355, switch 361, and circuit board 363 (microprocessor, etc.). Another completion route includes retention pin 354, retention mechanism 368, clutch wire 367 and circuit board 363 (microprocessor, etc.). This second tamper detection circuit monitors the integrity of lanyard 351. If lanyard 351 is cut, the first tamper detection circuit is still completed, while the second detection circuit is opened. When tag 350 detects that lanyard 351 has been cut, it self alarms with audible alarm generator 313 generating an audible sound. Some embodiments of tag 350 will self alarm when the body of tag 350 is opened or otherwise compromised. In this case the self alarm may be triggered by the displacement of circuit board 363 or other means.

Figure 7:
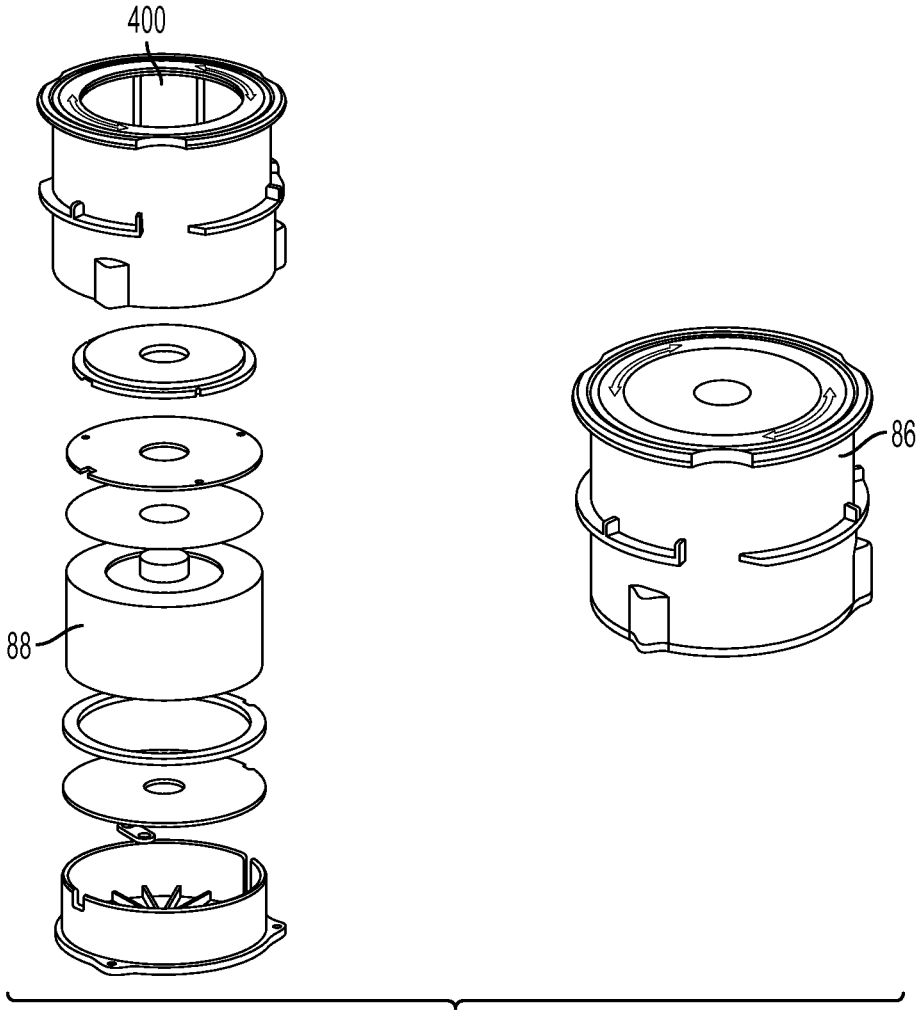
FIG. 7 is a perspective view and an exploded perspective view of a detacher.

FIG. 7 is an exploded view of an embodiment of a detacher 86. Detacher 86 has a magnet 88 sufficiently strong to allow detachment of tag 300 or tag 350 from an object. Application of detacher 86 to the appropriate area of a tag actuates a release mechanism having a magnetically attractable portion in it.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

While, for explanatory reasons, retail applications have been discussed in more detail, other embodiments of the invention may be used to track persons. For example, embodiments of the invention may be used to track newborns at hospitals, elderly people at assisted living facilities, and inmates of corrections facilities where it is desirable to monitor the presence of a person within an area. In those cases, FIG. 2 can be thought of as illustrating a nurses' station or an administrators' station, and the term "item" would apply to a person wearing an embodiment of a tag of the present invention. Additionally, any operation that needs to maintain control of assets within a given area, such as an R&D group, would benefit from an application of an embodiment of the invention.

I claim:

1. An asset protection system comprising;

at least one monitoring field transmitter, said at least one monitoring field transmitter maintaining a monitoring field of a predetermined radio frequency in an area to be monitored, and;

at least one anti-theft tag, said at least one anti-theft tag comprising an attaching mechanism for attaching said at least one anti-theft tag to an item to be protected, said at least one anti-theft tag further comprising electronic components located in the body of said at least one anti-theft tag, said electronic components comprising a microprocessor, a motion detector, an audible alarm generator, a battery, and radio frequency circuitry, said radio frequency circuitry being capable of transmitting and receiving radio frequency signals and detecting said monitoring field, wherein;

an item to be protected is initially placed in said area to be monitored with an anti-theft tag attached to said item by said attaching mechanism, excepting said motion detector and said microprocessor operating in a minimized mode, said electronic components being dormant when said anti-theft tag is not in motion, wherein;

when said motion detector determines said anti-theft tag is being moved, said microprocessor switches to an active mode, said electronic components become active, and said microprocessor determines whether said radio frequency circuitry detects a field at said predetermined frequency.

2. The asset protection system of claim 1 wherein;

when said active radio frequency circuitry of said at least one anti-theft tag does not detect a field at said predetermined frequency said microprocessor determines an alarm condition and said at least one anti-theft tag generates an alarm.

3. The asset protection system of claim 1, comprising;

at least two of said monitoring field transmitters, each of said monitoring field transmitters receiving power from an alternating current mains power source, each of said monitoring field transmitters capable of detecting particular points in the sinusoidal voltage wave of the mains power source for reference to synchronize with other monitoring field transmitters in the asset protection system.

4. The asset protection system of claim 3, wherein;

said particular points in said sinusoidal voltage wave are zero crossing points.

5. The asset protection system of claim 1, wherein;

said monitoring field has a code modulated onto it, said at least one anti-theft tag being capable of deciphering said code to confirm said anti-theft tag's location within said area to be monitored.

6. The asset protection system of claim 5, wherein;

when said at least one anti-theft tag is blocked from detecting said monitoring field, said at least one anti-theft tag generates an alarm signal.

7. The asset protection system of claim 5, further comprising;

at least one interference transmitter unit, said at least one interference transmitter unit maintaining an interference field at a radio frequency close enough to said predetermined radio frequency of said monitoring field such that both said interference field and said monitoring field are within the receiving bandwidth of said radio frequency circuitry of said at least one anti-theft tag, wherein said interference field does not have said code modulated on it, preventing said at least one anti-theft tag from deciphering said code, said interference field thereby shaping said monitoring field.

8. The asset protection system of claim 7, wherein;

each of said interference transmitter units receiving power from an alternating current mains power source, each of said interference field transmitters capable of detecting particular points in the sinusoidal voltage wave of the mains power source for reference to synchronize with other monitoring field transmitters in the asset protection system.

9. The asset protection system of claim 8 wherein;

said particular points in said sinusoidal voltage wave are zero crossing points.

10. The asset protection system of claim 7, wherein;

when said at least one anti-theft tag fails to detect said monitoring field and decipher said code, said at least one anti-theft tag generates an alarm signal.

11. The asset protection system of claim 10, wherein;

said alarm signal is an audible alarm generated by said audible alarm generator.

12. The asset protection system of claim 10, wherein;

said alarm signal is a radio frequency signal generated by said radio frequency circuitry of said at least one anti-theft tag.

13. The asset protection system of claim 12, wherein;

said interference transmitter unit is further capable of receiving said radio frequency signal alarm signal from said at least one anti-theft tag and generating an alarm when said interference transmitter unit receives said alarm signal.

14. The asset protection system of claim 7, comprising;

an interference transmitter unit at each exit from said area to be monitored.

15. The asset protection system of claim 1, further comprising;

at least one controller, said controller comprising a communication pad, and a keypad, said communication pad being capable of communication with said at least one anti-theft tag via radio frequency communications.

16. The asset protection system of claim 15, wherein;

said controller further comprises a display screen.

17. The asset protection system of claim 15, wherein;

said controller communicates data information, status, and programming information to said at least one anti-theft tag, and receives data information, status, and programming information from said anti-theft tag.

18. The asset protection system of claim 15, wherein;

to disarm said at least one anti-theft tag, said controller receives a unique tag identifier from said at least one anti-theft tag and responds with a passcode to said at least one anti-theft tag, said at least one anti-theft tag compares said passcode to a value stored in said at least one anti-theft tag, and said at least one anti-theft tag disarming if said passcode matches said stored value.

19. The asset protection system of claim 18, wherein;

said passcode is unique to each of said at least one anti-theft tag.

20. The asset protection system of claim 18, wherein;

said passcode is the same passcode for each of said at least one anti-theft tag.

21. The asset protection system of claim 18, wherein;

said area to be monitored is a retail area having at least one said controller at each point of sale location within said area to be monitored.

22. The asset protection system of claim 15, wherein;

said area to be monitored is a retail area having at least one said controller at each point of sale location within said area to be protected.

23. The asset protection system of claim 15, wherein;

said electronic components of each of said at least one anti-theft tag further comprise a clock and said microprocessor is programmed with an initial passcode and machine executable instructions for an algorithm that changes said passcode at specified intervals;

and said at least one controller further comprises a clock and a microprocessor, said microprocessor being programmed with machine executable instructions for an algorithm that tracks the passcodes at of said at least one anti-theft tag by updating the passcode at specified intervals.

24. The asset protection system of claim 1, wherein;

if said at least one anti-theft tag is detached from an item to be protected without being disarmed, said at least one anti-theft tag determines an alarm condition and generates an alarm signal.

25. The asset protection system of claim 1, further comprising;

a computer, said computer providing database functions, said database functions including recording communications with anti-theft tags, recording information about items being protected, information about users operating said asset protection system, and information about transactions facilitating the introduction of protected items to said monitored area or the removal of protected items from said monitored area.

26. The asset protection system of claim 1, wherein;

said at least one anti-theft tag is releasable attached to said item to be protected.

27. The asset protection system of claim 1, further comprising;

a detacher for facilitating the release of said at least one anti-theft tag from said item to be protected.

28. The asset protection system of claim 27, wherein;

said detacher comprises a magnet to effect movement of a magnetically attractable element in said at least one anti-theft tag.

29. The asset protection system of claim 1, wherein;

said at least one anti-theft tag further comprises a tamper detection capability, said at least one anti-theft tag determining an alarm condition and generating an alarm when said tamper detection capability indicates that said at least one anti-theft tag is being tampered with.

30. The asset protection system of claim 10, wherein;

when said at least one anti-theft tag fails to detect said monitoring field and decipher said code and said at least one anti-theft tag is generating an alarm signal, said at least one anti-theft tag ceases to generate said alarm signal if it again does detect said monitoring field and decipher said code.

* * * * *